US008360283B1

(12) United States Patent
Tu

(10) Patent No.: US 8,360,283 B1
(45) Date of Patent: Jan. 29, 2013

(54) LIQUID FOAMING PUMP

(75) Inventor: Xufeng Tu, Yuyao (CN)

(73) Assignee: Zhejiang JM Industry Co., Ltd, Zhejiang (CN)

( * ) Notice: Subject to any disclaimer, the term of this patent is extended or adjusted under 35 U.S.C. 154(b) by 21 days.

(21) Appl. No.: 13/211,553

(22) Filed: Aug. 17, 2011

(51) Int. Cl.
*B67D 7/76* (2010.01)

(52) U.S. Cl. ..... 222/190; 222/321.7

(58) Field of Classification Search ..... 222/190, 222/321.1, 321.7, 321.9, 340, 341, 145, 5, 222/6
See application file for complete search history.

(56) References Cited

U.S. PATENT DOCUMENTS

| | | | | |
|---|---|---|---|---|
| 5,271,530 | A | 12/1993 | Uehira et al. | |
| 5,443,569 | A * | 8/1995 | Uehira et al. | 222/190 |
| 5,570,819 | A | 11/1996 | Uehira et al. | |
| 5,813,576 | A * | 9/1998 | Iizuka et al. | 222/190 |
| D452,822 | S | 1/2002 | Boshuizen et al. | |
| D456,260 | S | 4/2002 | Boshuizen et al. | |
| 6,536,629 | B2 * | 3/2003 | van der Heijden | 222/190 |
| 6,604,693 | B2 * | 8/2003 | Santagiuliana | 239/343 |
| 6,612,468 | B2 * | 9/2003 | Pritchett et al. | 222/190 |
| 6,840,408 | B1 | 1/2005 | Foster et al. | |
| 6,923,346 | B2 | 8/2005 | Foster et al. | |
| 7,004,356 | B1 | 2/2006 | Sayers | |
| 7,147,133 | B2 | 12/2006 | Brouwer et al. | |
| 7,641,077 | B2 * | 1/2010 | Law et al. | 222/190 |
| 8,056,767 | B2 * | 11/2011 | Mizushima et al. | 222/190 |
| 8,292,127 | B2 * | 10/2012 | van Der Heijden | 222/190 |
| 2002/0056730 | A1 | 5/2002 | van de Heijden | |
| 2002/0070238 | A1 | 6/2002 | Pritchett et al. | |
| 2004/0069807 | A1 | 4/2004 | Brouwer et al. | |
| 2005/0115988 | A1 | 6/2005 | Law et al. | |
| 2007/0045350 | A1 | 3/2007 | Lin | |
| 2007/0119864 | A1 | 5/2007 | Tsai | |
| 2008/0169311 | A1 | 7/2008 | van Der Heiiden | |
| 2008/0277426 | A1 | 11/2008 | van der Heiiden | |
| 2008/0314931 | A1 | 12/2008 | van der Heiiden | |
| 2009/0001100 | A1 | 1/2009 | van der Heiiden | |
| 2009/0020552 | A1 | 1/2009 | van der Heiiden | |
| 2009/0236371 | A1 | 9/2009 | Van Der Heiiden | |
| 2010/0001024 | A1 | 1/2010 | van Der Heiiden | |
| 2010/0096412 | A1 * | 4/2010 | Law et al. | 222/190 |

* cited by examiner

*Primary Examiner* — Lien Ngo
(74) *Attorney, Agent, or Firm* — Haugen Law Firm PLLP

(57) ABSTRACT

A liquid foaming dispenser includes multiple valve mechanisms for regulating the inflow and mixture of air and liquid to create a foamable preparation. A gasket incorporating a double-valve structure is employed to regulate air inflow from the external environment, and air delivery to the liquid in preparation for foaming. The valve-regulated foaming dispenser securely and precisely blends the air and liquid for consistent foaming results.

11 Claims, 5 Drawing Sheets

LIQUID FOAMING PUMP

FIELD OF THE INVENTION

The present invention relates to dispensers generally, and more particularly to a liquid foaming pump with an arrangement for efficiently foaming and dispensing foamed liquid from within a liquid container.

BACKGROUND OF THE INVENTION

Manual liquid dispensers of various sort have been widely implemented in a variety of applications. One type of liquid dispenser is a manually operated pump that is arranged to prepare a foam from a liquid in a container, and to dispense such foam under manual operation of the pump. In typical arrangements, the dispenser is in the form of a reciprocating pump that is manually operated by force applied against a restorative spring force of an expansion spring within a dispenser device, with the application and removal of the external force being sufficient to generate pressure changes in respective air and liquid chambers in the dispenser to alternately cause foaming/dispensing and intake of air and liquid for liquid foaming in the next pumping cycle.

A common type of foam dispenser includes those used in daily cosmetic and medicinal applications. Liquid force under pressure into an air-liquid mixing chamber generates a foamable mixture that, when forced through an obstruction, develops a relatively dense dispensable foam. Typically, liquid foaming dispensers of this type comprise a pump housing which contains an air pump chamber and a liquid pump chamber, and a piston that is manually reciprocated in the pump housing. The air piston and the liquid piston are mounted for reciprocating movement in the respective air and liquid chambers, such that movement of the pump against a spring force causes the air piston to move in the air chamber to thereby exert a compression force on the air in the chamber, and likewise the liquid piston in the liquid chamber to exert a compression force on the liquid in the liquid chamber. Valves control the flow of air and liquid from the respective air chamber and liquid chamber into an air-liquid mixing chamber where the air and liquid are mixed and driven through a foaming obstruction to generate the dispensable foam.

Release of the external downward force to the pump permits the spring to expand under its restorative force, and to thereby return the pumping mechanism to its extended position. This movement of the pump mechanism causes the air piston and the liquid piston to move in their respective air chamber and liquid chamber in a manner which expands the interior volumes of the two chambers. The negative pressures created by such movement draws air into the air chamber and liquid into the liquid chamber. Valve assemblies are typically employed in controlling the flow of air and liquid into the respective air chamber and liquid chamber as their interior volumes are increased by the movement of the pump mechanism.

While many pumping mechanisms and valve assemblies have been developed in the past to provide the functionality described above, efficiency and manufacturing can be a substantial driver in the marketability of such manual foaming dispensers. Therefore, improvements in the design of the foaming dispenser which even slightly reduces the manufacturing costs can result in significant benefit to the manufacture and sale of liquid foaming dispensers. Additionally, improvements can be made to the mechanism, including the valving arrangements, in order to more efficiently produce a consistent foam, and to limit "bleed" of air and/or liquid out from a designated operational pathway.

It is therefore an object of the invention to provide a liquid foaming dispenser which improves manufacturability.

It is another object of the present invention to provide a liquid foaming dispenser which improves operational effectiveness.

SUMMARY OF THE INVENTION

By means of the present invention, mixing of air and liquid in the preparation of a dispensable foam may be consistently metered through the manual actuation of a foaming pump. The dispenser of the present invention utilizes a double-valve gasket with a configuration which develops secure valve sealing when such sealing is critical to the precise operation of the foaming dispenser. In particular, the combination of air pressures within an air chamber and a deflection movement of the gasket under a first valve operation acts to enhance the sealing engagement of the other valve of the double-valve gasket. Such a utility is accomplished with an inexpensive and easily manufactured gasket, to thereby improve performance and reduce manufacturing costs in comparison to conventional foaming dispensers.

In one embodiment, the liquid foaming dispenser of the present invention includes a pump body having an air chamber and a liquid chamber, and defining a central axis that defines mutually perpendicular axial and radial directions, and a large piston rod having an air inlet aperture, an air passage, and a hollow interior defining an air-liquid mixing chamber. The dispenser further includes a large piston positioned in the air chamber, and being movable by the large piston rod. A small piston rod including a small piston base and liquid passage coordinates with a small piston positioned in the liquid chamber. The dispenser further includes a large piston gasket forming first and second one-way valves formed by a releasable engagement of first and second gasket flanges against respective sealing surfaces of the large piston rod. The first and second gasket flanges resiliently and radially outwardly bias against the respective sealing surfaces.

In another embodiment, the liquid foaming dispenser of the present invention includes a pump body having an air chamber and a liquid chamber, and a central axis that defines a mutually perpendicular axial and radial directions. The dispenser has a large piston rod having a hollow interior defining an air-liquid mixing chamber, an air inlet aperture for communicating air from an external environment to the air chamber, and an air passage for communicating air from the air chamber to the air-liquid mixing chamber. A large piston rod is positioned in the air chamber, and is axially movable by the large piston rod. The liquid inlet of the dispenser includes a first valve mechanism for regulating liquid flow into the liquid chamber. A small piston rod includes a second valve mechanism for regulating liquid flow from the liquid chamber to the air-liquid mixing chamber. The dispenser also includes a large piston gasket secured to the large piston rod, and including third and fourth valve mechanisms. The third valve mechanism regulates air flow through the inlet channel and includes a first gasket flange biasing radially outwardly against the large piston rod to establish the releasable engagement forming the third valve mechanism. The fourth valve mechanism regulates air flow through the air passage and includes a second gasket flange biasing radially outwardly against the large piston rod to establish a releasable engagement forming the fourth valve mechanism.

Another embodiment of the liquid foaming dispenser of the present invention includes a pump body having an air chamber and a liquid chamber, and a central axis that defines mutually perpendicular axial and radial directions. The dispenser also includes a large piston rod having a hollow interior defining an air-liquid mixing chamber, an air inlet aperture for communicating air from an external environment to the air chamber, an air passage for communicating air from the air chamber to the air-liquid mixing chamber, an inner securement channel with an outer stud, and an outer securement channel with an inner stud. A large piston is positioned in the air chamber, and is axially movable by the large piston rod. A small piston rod including a small piston base and a liquid passage is provided with a small piston positioned in the liquid chamber. The dispenser further includes a large piston gasket having a main body portion, an inner circumaxial ring extending radially inwardly from the main body portion, an outer circumaxial ring extending radially outwardly from the main body portion, an inner securement flange extending axially in a first direction from the inner circumaxial ring to engage within the inner securement channel of the large piston rod, and an outer securement flange extending axially in the first direction from the outer circumaxial ring to engage within the outer securement channel of the large piston rod. The large piston gasket includes a first gasket flange extending from the main body portion and resiliently and radially outwardly biasing against the large piston rod, and a second gasket flange extending from the main body portion and resiliently and radially outwardly biasing against the large piston rod. The first gasket flange forms a first valve mechanism for regulating airflow from an external environment through the inlet channel of the large piston gasket, and the second gasket flange forms a second valve mechanism for regulating airflow from the air chamber through the air passage.

BRIEF DESCRIPTION OF THE DRAWINGS

FIG. 6 is an isolation view of a portion of the liquid foaming dispenser illustrated in

FIG. 1.

DETAILED DESCRIPTION OF THE PREFERRED EMBODIMENTS

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Figure 1:
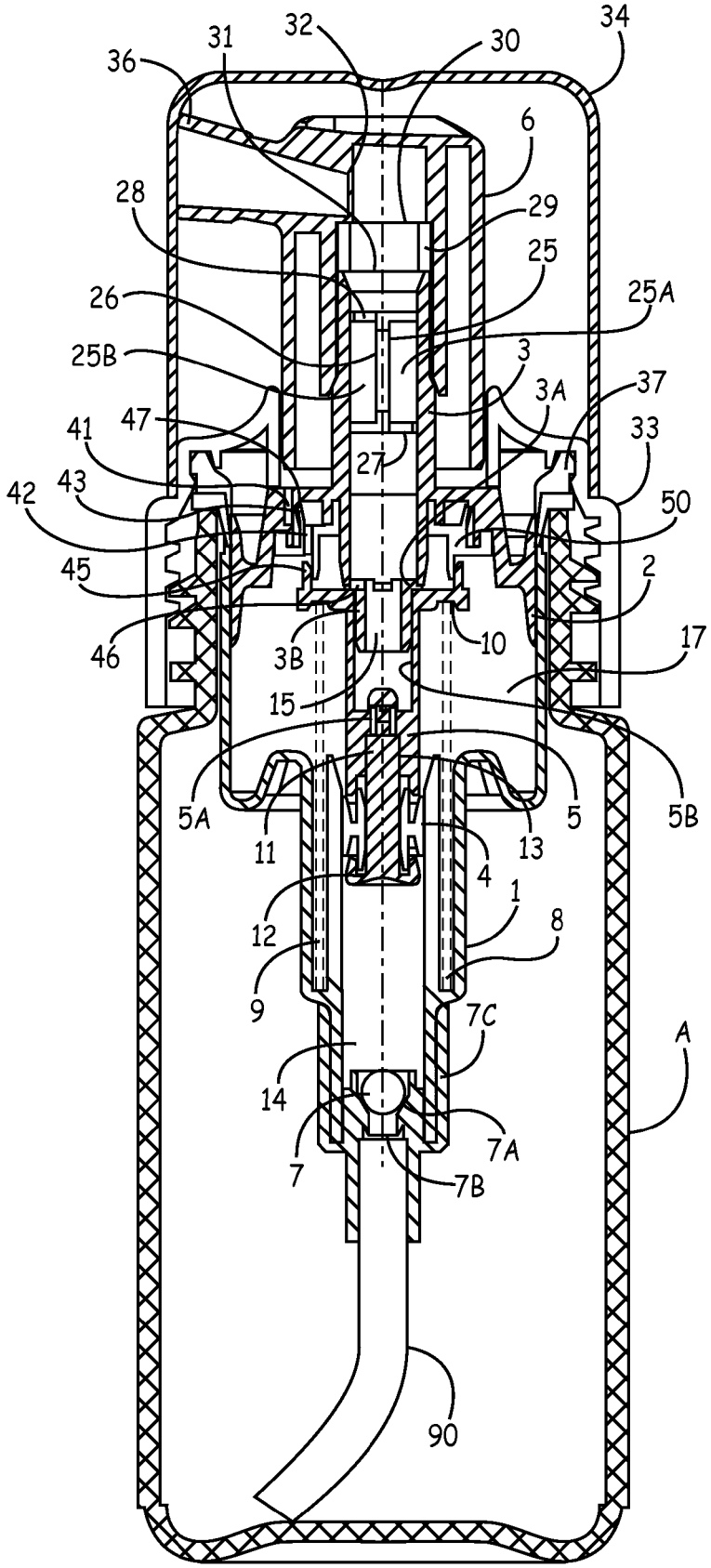
FIG. 1 is a cross-sectional view of a liquid foaming dispenser of the present invention.

With reference now to the drawing figures, and first to FIG. 1, a liquid foaming dispenser of the present invention may be operated by connecting the dispenser to a container "A" containing a liquid to be dispensed. In the following description of the invention, the terms "top" and "bottom", "upper" and "lower", or similar related terms are used to describe the component parts of the dispenser and their relative positions. Such terms are used only with respect to the drawings, and should not be considered limiting as to the absolute orientation of the component parts in operation.

As illustrated in FIG. 1, the dispenser includes a pump body 1 having a large piston 2, a large piston rod 3, a small piston 4 and a small piston rod 5, which components reciprocally move up and down together upon a pumping action imparted upon a dispensing cap 6. The materials employed in constructing the component parts of the dispenser are those typically used in the industry, such as various plastics.

At a lower end of pump body 1, a first valve is established for permitting liquid flow from within container "A" into liquid chamber 14. In one embodiment, the first valve may be established as a one-way valve through a ball 7 displacably engaged with a ball seat 7A. In a "liquid draw" condition of the dispenser, ball 7 may be displaced from sealing engagement with ball seat 7A, thereby permitting liquid to pass by ball 7 and into liquid chamber 14. To draw liquid from the deepest portion of the container "A", a dip tube 90 may convey liquid from within container "A" to inlet 7B of the dispenser.

In one embodiment, ball seat 7A is a shaped portion of inlet adapter sleeve 7C which engages with lower end of pump body 1. Ball 7 is displaced from ball seat portion 7A of inlet adapter sleeve 7C only under the urging of a negative pressure force within liquid chamber 14. The illustrated ball and ball seat arrangement, however, is exemplary only, and Applicant anticipates the use of other forms of a one-way valve at the first valve mechanism of the foaming dispenser.

A ring groove 8 is formed by pump body 1 with a generally U-shaped cross-section to receive spring 9 in a compressed condition between ring groove 8 and supporting ring 10 of small piston rod 5. In such an arrangement, the restorative force of spring 9 acts against supporting ring 10 to urge small piston rod 5, and large piston rod 3, upwardly along a central axis "X" of the foaming dispenser.

Figure 5:
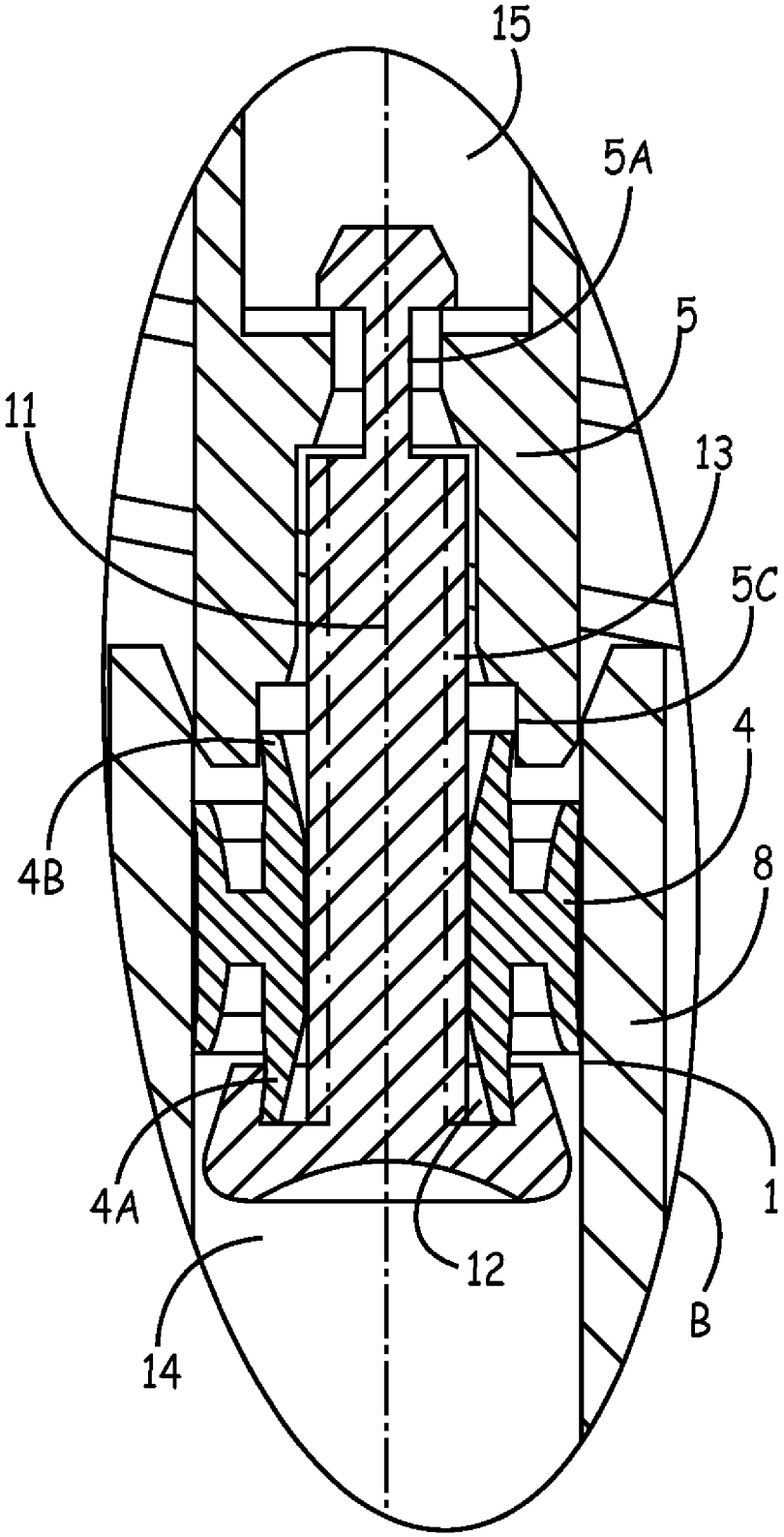
FIG. 5 is an enlarged cross-sectional view of a portion of the liquid foaming dispenser illustrated in FIG. 1.

Small piston base 11 is secured to small piston rod 5 within a liquid passage 5A. Small piston base 11 is configured to receive small piston 4, wherein small piston 4 may be slidably secured on small piston base 11 to releasably engage in ring groove 12 of small piston base 11. An enlarged view of the relationship among small piston rod 5, small piston base 11, and small piston 4 is illustrated in FIG. 5. Small piston 4 is operably mounted at pump body 1 and small piston base 11 to form a second valve of the foaming dispenser in regulating liquid transfer from liquid chamber 14 through liquid passage 5A into air-liquid mixing chamber 15. The liquid pathway from liquid chamber 14 into air-liquid mixing chamber 15 is opened upon the slidable disengagement of small piston flange 4A from small piston base 11 at ring groove 12. Once disengaged, liquid from liquid chamber 14 may pass around flange 4A of small piston 4 in ring groove 12, and along groove 13 in small piston base 11 to liquid passage 5A between small piston base 11 and small piston 5. Reverse slidable relative movement between small piston 4 and small piston base 11 re-engages flange 4A of small piston 4 with small piston base 11 at ring groove 12. The operation of small piston 4 as the second valve mechanism of the foaming dispenser to regulate liquid flow from liquid chamber 14 into air-liquid mixing chamber 15 will be described in greater detail hereinbelow.

Large piston 2 may be secured to, or integrally formed with large piston rod 3 for reciprocal pumping action with respect to air chamber 17. Large piston 2 sealingly, but slidingly engages with pump body 1 to reciprocally reduce and expand volume within air chamber 17. In the illustrated embodiment, large piston 2 is integrally formed with large piston rod 3, such that reciprocal pumping action of large piston rod 3 simultaneously acts upon large piston 2 in air chamber 17.

Large piston rod 3 may be substantially hollow to define at least a portion of air-liquid mixing chamber 15 therewithin. Large piston rod 3 further includes a shoulder 3A that contacts supporting ring 10 of small piston rod 5. During the downward pumping portion of the cycle, shoulder 3A of large piston rod 3 bears against supporting ring 10 of small piston rod 5 to force small piston rod 5 downward into liquid chamber 14. Upon release of a downwardly directed external force upon large piston rod 3, spring 9 urges upwardly against supporting ring 10 of piston rod 5, which, in turn bears against shoulder 3A of large piston rod 3 to drive large piston rod 3 upwardly to a full extension point. Insert portion 3B of large piston rod 3 engages with an interior surface 5B of small piston rod 5. Typically, a friction fit is established between insert portion 3B of large piston rod 3 and inner surface 5B of small piston rod 5.

A large piston gasket 50 is secured between large piston rod 3 and small piston rod 5 to establish a double-valve gasket structure to form third and fourth valve mechanisms of the foaming dispenser. Large piston gasket 50 includes an inlet hole 42 which permits inlet air flow to air chamber 17 from the external environment through air inlet aperture 41 in large piston rod 3. Therefore, on the upstroke of large piston rod 3, negative pressure is developed in air chamber 17 due to the movement of large piston 2 upwardly to enlarge the sealed volume of air chamber 17. The negative pressure draws external air through air inlet aperture 41 in large piston rod 3, and deflects first gasket flange 43 of large piston gasket 50 away from a first sealing surface 47 of large piston rod 3 to open access of the inlet air to inlet hole 42 of large gasket 50. The releasable engagement of first gasket flange 43 to first sealing surface 47 of large piston rod 3 therefore forms the third valve mechanism of the foaming dispenser.

On the downstroke of the pumping cycle, movement of large piston 2 into air chamber 17 increases the internal pressure by reducing the sealed volume within air chamber 17. The increased internal pressure within air chamber 17 eventually becomes sufficient to displace second gasket flange 45 of large piston gasket 50 away from second sealing surface 48 of small piston rod 5 to thereby permit air passage between second gasket flange 45 and second sealing surface 48 to escape from air chamber 17 through air passage 46 into air-liquid mixing chamber 15. The releasable engagement of second gasket flange 45 of large piston gasket 50 with second sealing surface 48 of small piston rod 5 therefore forms the forth valve mechanism of the foaming dispenser. Air passageway 46 may be formed as an aperture in large piston rod 3 to fluidly communicate between air chamber 17 and air-liquid mixing chamber 15 during the downstroke of the pumping cycle. Air passage 46 may remain open throughout the pumping cycles of the foaming dispenser, with second gasket flange 45 providing a barrier to leakage of material in air-liquid mixing chamber 15 into air chamber 17 when sealed against second sealing surface 48 of small piston rod 5.

Large piston gasket 50 may be manufactured from a resiliently pliant yet structurally strong material, such as various plastics. In the illustrated embodiment, as best viewed in FIGS. 2 and 3, large piston gasket 50 may be formed as a substantially "H"-shaped structure incorporating the above-described third and fourth valve mechanisms as a double-valve defining body. Large piston gasket 50 may be secured to large piston rod 3 at the interface of inner and outer securement flanges 52, 54 with respective inner and outer securement channels 56, 58 formed in large piston rod 3. In the illustrated embodiment, inner securement channel 56 operably receives inner securement flange 52 of large piston gasket 50 at a position radially inwardly of a deflection axis 60 of large piston gasket 50, while outer securement channel 58 is positioned to operably receive outer securement flange 54 at a position radially outwardly of deflection axis 60. In the illustrated embodiment, inner and outer securement flanges 52, 54 are oriented upwardly into respective downwardly-oriented securement channels 56, 58 in large piston rod 3.

Inner securement flange 52 extends orthogonally from inner circumaxial ring 62, which itself extends circumaxially about central axis "X" of the foaming dispenser, and radially inwardly from main body portion 64 of large piston gasket 50. Outer stud 56A of inner retention channel 56 abuts an upper surface of circumaxial ring 62 to further secure large piston gasket 50 in place between large piston rod 3 and small piston rod 5. Outer securement flange 54 extends orthogonally from outer circumaxial ring 66, which itself extends radially outwardly from main body portion 64. Inner stud 58A abuts an upper surface of outer circumaxial ring to further secure large piston gasket 50 in place between large piston rod 3 and small piston rod 5. Inner and outer circumaxial rings 62, 66 may be substantially parallel to one another across a bisecting mid-plane 70 perpendicular to central axis X.

First and second gasket flanges 43, 45 extend substantially oppositely from main body portion 64 of large piston gasket 50, and generally parallel to deflection axis 60. In a preferred embodiment, first gasket flange 43 is disposed radially outwardly from deflection axis 60, while second gasket flange 45 is disposed radially inwardly of deflection axis 60, which deflection axis 60 may be substantially parallel to central axis "X" of the foaming dispenser. Such an arrangement is particularly useful in the illustrated embodiment, wherein first gasket flange 43 biasably engages against first sealing surface 47 of large piston rod 3 along a radially-outwardly directed force vector generated by the biasing force of first gasket flange 43. Second gasket flange 45 biasably seals against second sealing surface 48 of small piston rod 5, with the biasing force of second gasket flange 45 also being directed generally radially outwardly against second sealing surface 48. By positioning first and second gasket flanges 43, 45 on opposite radial sides of deflection axis 60, in combination with the directions of biasing force of first and second gasket flanges 43, 45 against the respective first and second sealing surfaces 47, 48 in the releasable sealing engagement therebetween, a secure sealing engagement of the non-deflected gasket flange 43, 45 is facilitated during an operation of one of the third and fourth valve mechanisms. For instance, intake of external air through air inlet aperture 41 of large piston rod 3 is facilitated by negative pressure within air chamber 17 deflecting first gasket flange 43 away from first sealing surface 47. The negative pressure within air chamber 17 tends to urge second gasket flange 45 against second sealing surface 48 while simultaneously deflecting first gasket flange 43 away from first sealing surface 47. Such urging enhances the sealing engagement of the fourth valve mechanism, constituted by the sealing contact between second gasket flange 45 and second sealing surface 48. Such a seal remaining at the fourth valve mechanism during the intake of external air to air chamber 17 prevents simultaneous intake of material from air-liquid mixing cavity 15 into air chamber 17.

In like manner to the above description, air discharge from air chamber 17 into air-liquid mixing chamber 15 during the down-stroke portion of the pumping cycle displaces second gasket flange 45 away from second sealing surface 48, and tends to urge first gasket flange 43 against first sealing surface 47. Such urging is a result of both positive pressure placed upon an inner radial surface of first gasket flange 43 by the air in the air chamber 17, as well as a rotational urging caused by the deflection of second gasket flange 45 away from second sealing surface 48. Such enhanced sealing of first gasket flange 43 to first sealing surface 47 prevents leakage of pressurized air out through air inlet aperture 41, and instead promotes all air discharge through air passage 46 into air-liquid mixing chamber 15. The configuration of large piston gasket 50, with first and second gasket flanges 43, 45 being operably disposed across deflection axis 60 maximizes the sealing "enhancement" forces generated in the pumping cycle, and described above. It is therefore submitted that the illustrated embodiment of large piston gasket 50 provides a significantly improved and reliable double-valve sealing gasket than that currently available, and assures consistent air flow into and out form air chamber 17 without leakage.

Figure 6:
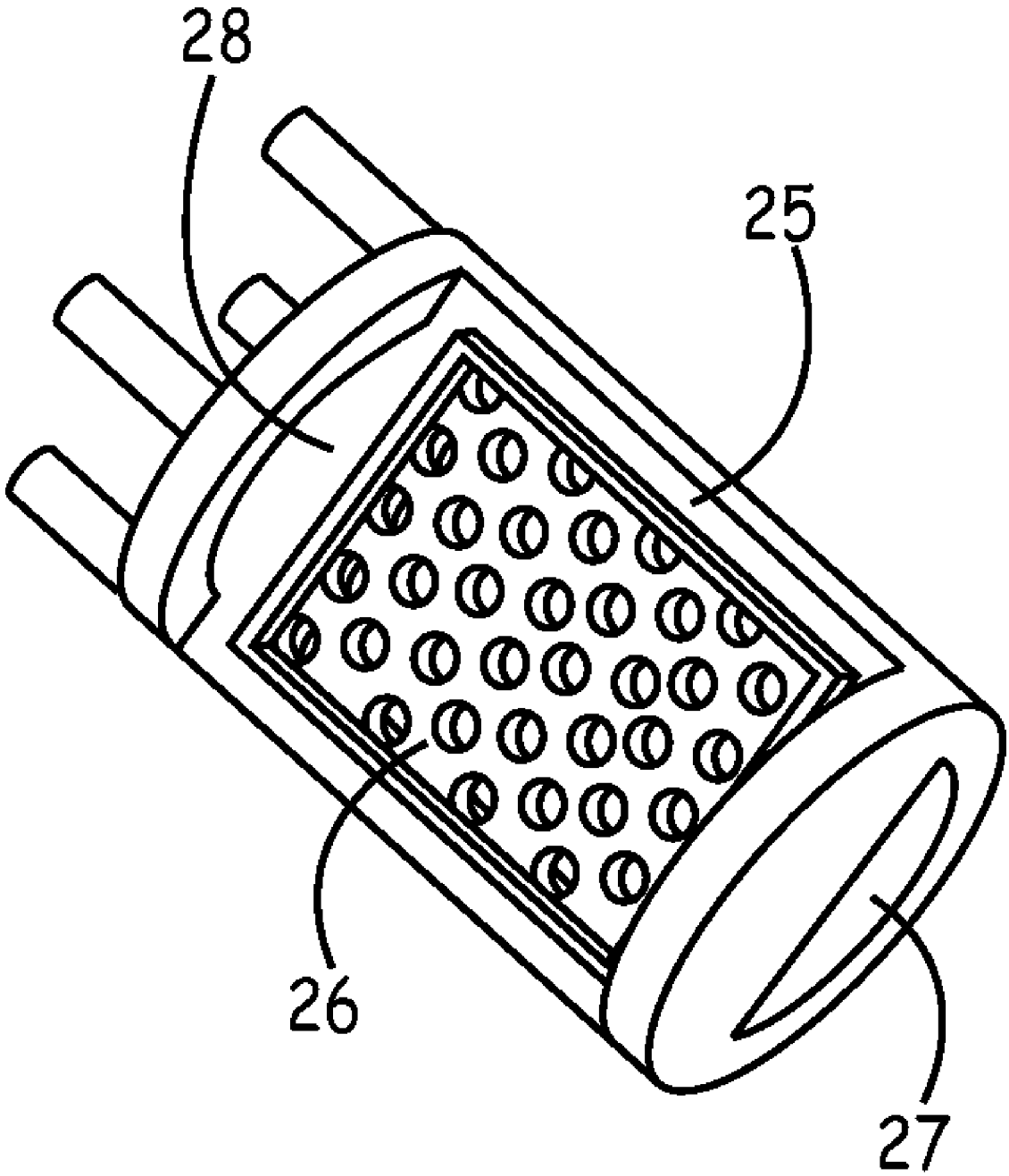

A reticulated foam base 25 is secured within the hollow chamber defined by large piston rod 3, wherein reticulated foam base 25 supports a reticulated foam meshwork 26, which separates inlet 27 from outlet 28. An isolation view of reticulated foam base 25 is illustrated in FIG. 6, with inlet 27 disposed at a lower portion of base 25 to permit influx of the foamable air-liquid mixture within air-liquid mixing chamber 15 into a first foaming chamber 25A. Pumping force of the air-liquid mixture further causes the mixture to pass through foam meshwork 26 along a substantially perpendicular direction to central axis "X" of the foaming dispenser, which can greatly improve the foaming effect of the reticulated foam meshwork. The foamed mixture accordingly passes into second foaming chamber 25B, and out from base 25 through outlet 28.

An upper reticulated foam meshwork 30 and a lower reticulated foam meshwork 31 are disposed between an upper end 3A of large piston rod 3 and pump cap 6 in the foamed air-liquid mixture outlet pathway to further foam the mixture a second and a third instance. Upper and lower reticulated foam meshworks 30, 31 are disposed at a spacer 29 within a zone formed by dispensing cap 6. A fourth foaming instance is achieved at a foaming hole 32 at the entrance to a nozzle outlet 36 of dispensing cap 6.

Dispensing cap 6 may be operably mounted to and about large piston rod 3, wherein downward pressure on dispensing cap 6 is transmitted to large piston rod 3 and, in turn, to small piston rod 5. Dispensing cap 6 may further be tensibly secured into a center hole of large cap 33, which is connected to pump body 1 at connection point 37, and threadably secured to container "A". In the illustrated embodiment, a transparent shield 34 removably covers large cap 33 and dispensing cap 6.

The principles of operation of the present invention are now described with reference to the illustrated embodiment. Other embodiments of the invention, however, are contemplated as being employable in the present invention. Upon application of downward force to dispensing cap 6, downward motion of dispensing cap 6 is translated to large piston rod 3, and correspondingly to small piston rod 5 at the interface of shoulder 3A of large piston rod 3 and supporting ring 10 of small piston rod 5. The downward movement of large piston rod 3 correspondingly causes large piston 2 to sealingly move downward into air chamber 17, which decreases the volume of air chamber 17, and correspondingly increases the internal air pressure therewithin. The increased pressure within air chamber 17 during the compression stroke of large piston 2 forces air within air chamber 17 to force open the fourth valve mechanism, which constitutes a one-way valve formed by second gasket flange 45 of large piston gasket 50 engaged against second sealing surface 48 of small piston rod 5. The air pressure displaces second gasket flange 45 out from engagement with second sealing surface 48 to permit air to pass through the fourth valve mechanism, and through air passage 46 so as to access air-liquid mixing chamber 15. During this compression stroke, first gasket flange 43 remains sealingly engaged with first sealing surface 47 of large piston rod 3 so as to prevent air from escaping out from air inlet aperture 41. As described above, the specific configuration of large piston gasket 50, including first and second gasket flanges 43, 45 being respectively disposed radially inwardly and radially outwardly of deflection axis 60, enhances the sealing engagement of first gasket flange 43 with first sealing surface 47.

The translated downward motion of small piston rod 5 overcomes the expansion force of spring 9 to correspondingly move small piston base 11 downwardly into liquid chamber 14. The mounting of small piston 4 to the inner wall of pump body 1 assumes a frictional fit that is at least slightly greater than the frictional fit of the mounting of small piston 4 to small piston base 11. Consequently, downward motion of small piston base 11 overcomes the frictional fit between small piston 4 and small piston base 11 to thereby cause relative motion of small piston 4 relative to small piston base 11 while small piston 4 remains stationary with respect to pump body 1. Such relative motion disengages small piston flange 4A from sealing engagement with small piston base 11 at ring groove 12 to thereby open the first valve mechanism. Continued downward movement of small piston rod 5 and small piston base 11 eventually results in contact between recess surface 5C of small piston rod 5 and upper flange 4B of small piston 4. Such contact, and continued downward movement of small piston rod 5 overcomes the frictional connection of small piston 4 with pump body 1, wherein small piston 4 then moves in conjunction with small piston rod 5, and relative to pump body 1. As small piston 4 moves downwardly with small piston rod 5 and small piston base 11, pressure within liquid cavity 14 is increased. Such increased fluid pressure in liquid cavity 14 forces ball 7 against ball seat 7A, thereby sealingly closing the first valve mechanism of the foaming pump to prevent liquid from escaping from liquid chamber 14 out through inlet 7B. Furthermore, the increased pressure in liquid chamber 14 drives liquid through the now-opened second valve mechanism by passing around lower flange 4A of small piston 4, and into groove 13 and liquid passage 5A, and ultimately into air-liquid mixing chamber 15.

The liquid and air mix within air-liquid mixing cavity 15, and the mixture is forced under pressure through the reticulated foam meshwork 26 of foam base 25, as well as upper and lower foam meshworks 30, 31 before exiting a foaming hole 32 at the nozzle outlet 36 of dispensing cap 6. The process of the liquid/air mixture passing through such apertured substrates results in the generation of a foam for dispensation out from the nozzle 36.

Removal of the downward pressure upon dispensing cap 6, and translationally to large piston rod 3 and small piston rod 5, causes small piston rod 5 to move upward upon the urging of the elastic force of spring 9 to correspondingly drive large piston rod 3 upward due to the interaction of small piston rod 5 and large piston rod 3 at supporting rod 10 and shoulder 3A. As in the initial downward movement of small piston base 11 with respect to small piston 4, initial upward movement of small piston base 11 overcomes the frictional coupling of small piston 4 to small piston base 11, and causes small piston base 11 to move upwardly with respect to small piston 4, which remains stationary with respect to pump body 1 until lower small piston flange 4A comes into contact with small piston base 11 at ring groove 12. Continued upward motion of small piston base 11 forces small piston 4 to move in coordination with small piston base 11, and relative to pump body 1. The contact between lower flange 4A of small piston 4 with small piston base 11 at ring groove 12 closes the second valve mechanism, and prevents liquid flow to or from liquid chamber 14 through the second valve mechanism constituted by small piston 4 and small piston base 11.

Continued upward motion of small piston rod 5, small piston base 11, and small piston 4 increases the volume within liquid chamber 14 to correspondingly decrease the fluid pressure therein. In response to such decreased pressure, ball 7 releases its sealing contact with ball seat 7A to thereby open the first valve mechanism of the foaming dispenser. The opened first valve mechanism, in combination with the reduced fluid pressure in liquid chamber 14, draws liquid from within container "A" into liquid chamber 14 through inlet 7B. Meanwhile, the sealing engagement of the second valve mechanism constituted by lower piston flange 4A and small piston base 11 prevents flow of liquid from air-liquid mixing chamber 15 into liquid chamber 14.

Upward movement of large piston rod 3, urged by small piston rod 5, which itself is urged upwardly by spring 9, causes large piston 2 to move upwardly in air chamber 17 to thereby increase the volume and decrease the pressure within air chamber 17. The decreased air pressure within air chamber 17 causes first gasket flange 43 to be deflected away from first sealing surface 47 of large piston rod 3. Such deflection allows inlet air to enter air chamber 17 through air inlet aperture 41 and inlet hole 42 in large piston gasket 50. As indicated above, the reduced air pressure within air chamber 17, as well as the rotational movement of large piston gasket 50 generated through the deflection of first gasket flange 43 away from first sealing surface 47, enhances the sealing contact between second gasket flange 45 and second sealing surface 48, to thereby securely prevent intrusion of air-liquid mixture from air-liquid mixing chamber 15 into air chamber 17.

Figure 2:
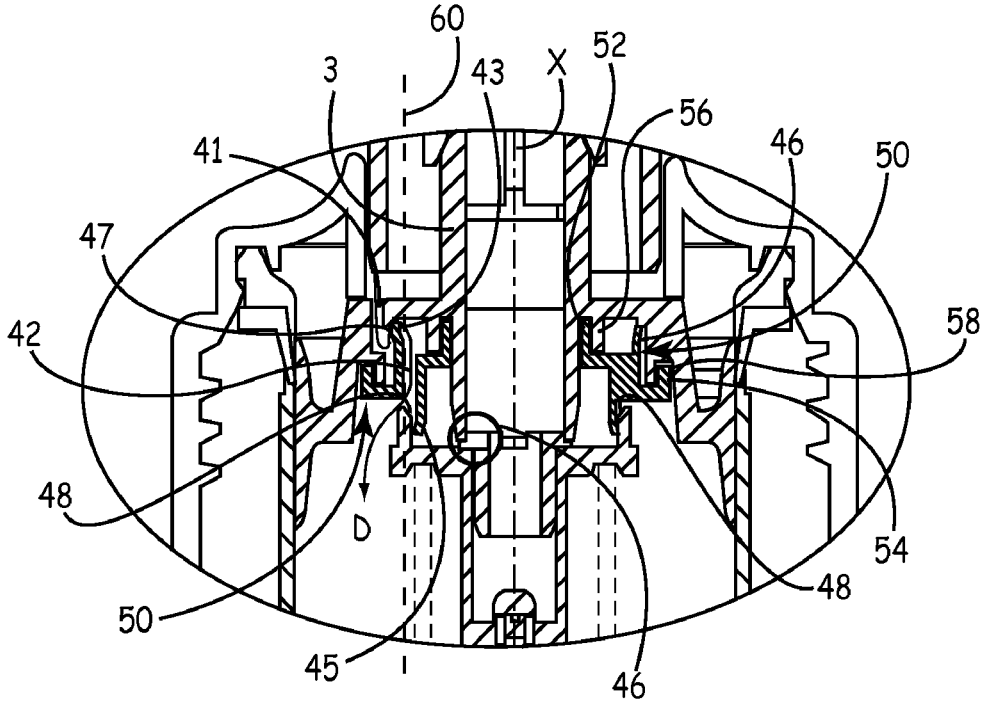
FIG. 2 is an enlarged cross-sectional view of a portion of the liquid foaming dispenser illustrated in FIG. 1.
Figure 3:
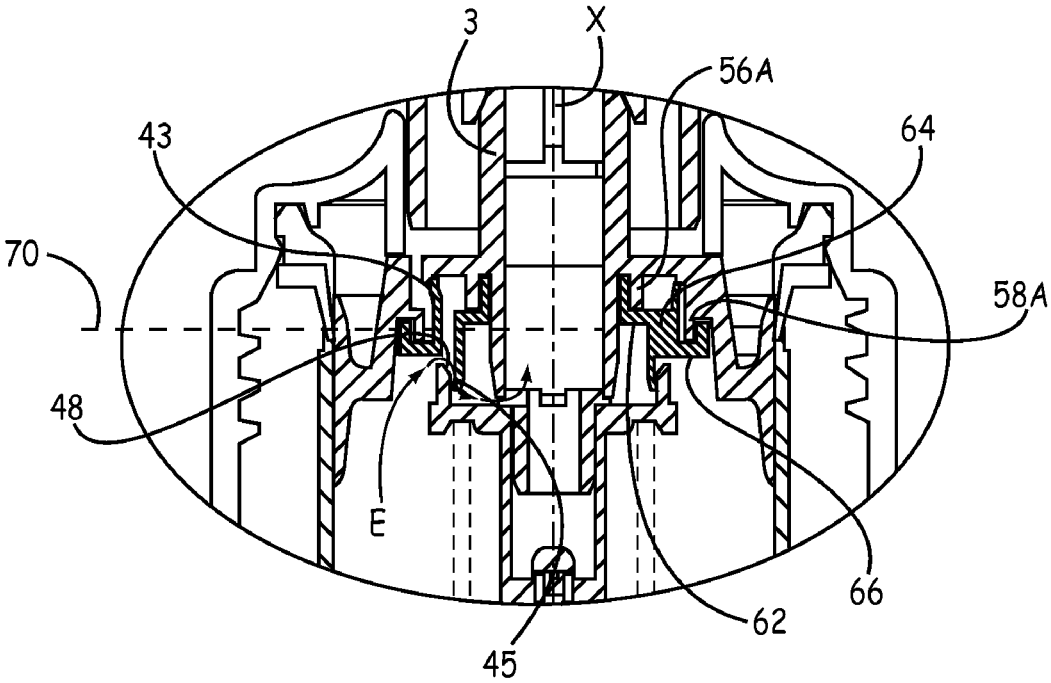
FIG. 3 is an enlarged cross-sectional view of a portion of the liquid foaming dispenser illustrated in FIG. 1.
Figure 4:
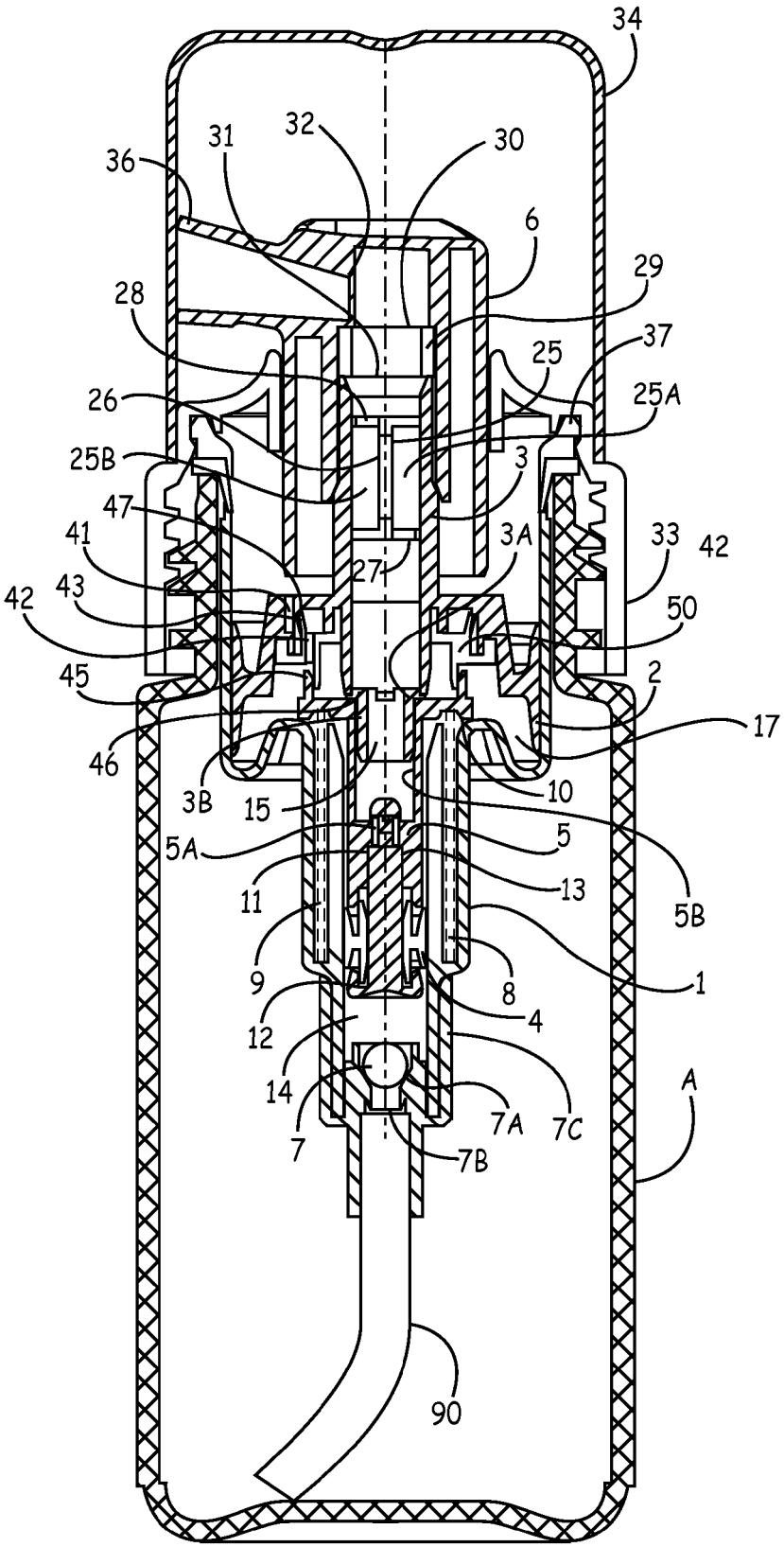
FIG. 4 is a cross-sectional view of the liquid foaming dispenser of FIG. 1 during a downstroke portion of the pump cycle.

FIGS. 2 and 3 illustrate the air paths during the compression and expansion strokes of each pump cycle. Air flow is depicted by directional arrows (D, E). FIG. 2 represents the expansion stroke of the pump cycle, wherein air is drawn into the air chamber 17 through air inlet aperture 41 and inlet hole 42, as depicted by directional arrow "D". Mixing airflow into air-liquid mixing chamber 15 through air passage 46 is depicted in FIG. 3 by directional arrow "E". In the compression stroke, large piston rod 3 is driven downwardly, such that second gasket flange 45 is displaced from second sealing surface 48 to allow the air flow along directional arrow "E". Meanwhile, first gasket flange 43 is pressed against first sealing surface 47 under the positive pressure within air chamber 17. During the expansion stroke of the pump cycle, large piston rod 3 goes up under the expansive force of spring 9, resulting in a negative pressure within air chamber 17 to close the second gasket flange 45 against the second sealing surface 48, and to open first gasket flange 43 by displacing it from first sealing surface 47.

When spring 9 urges small piston rod 5, and correspondingly large piston rod 3, to the uppermost extension position, the foaming dispenser is then ready for another pumping cycle, with both air chamber 17 and liquid chamber 14 filled with the components necessary for creating a dispensable foam.

The invention has been described herein in considerable detail in order to comply with the patent statutes, and to provide those skilled in the art with the information needed to apply the novel principles and to construct and use embodiments of the invention as required. However, it is to be understood that the various modifications may be accomplished without departing from the scope of the invention.

What is claimed is:

1. A liquid foaming dispenser, comprising:

a pump body having an air chamber and a liquid chamber, and defining a central axis that defines mutually perpendicular axial and radial directions;

a large piston rod having an air inlet aperture and an air passage, and a hollow interior defining an air-liquid mixing chamber;

a large piston positioned at said air chamber and sealingly engaged to said pump body, said large piston being axially movable by said large piston rod;

a small piston rod including a small piston base and a liquid passage;

a small piston positioned in said liquid chamber and sealingly engaged to said pump body, said small piston being axially movable by said small piston base; and a large piston gasket having a main body portion, an inlet hole through said body portion, and a deflection axis passing through said main body portion, said deflection axis being substantially parallel to said central axis, said large piston gasket forming first and second one-way valves, said first one-way valve being formed by a releasable engagement of a first gasket flange against a first sealing surface of said large piston rod, said first gasket flange resiliently and radially outwardly biasing against said first sealing surface at a first location radially outward from said deflection axis, and said second one-way valve being formed by a releasable engagement of a second gasket flange against a second sealing surface of said small piston rod, said second gasket flange resiliently and radially outwardly biasing against said second sealing surface at a second location radially inward from said deflection axis, wherein the engagement of said first gasket flange to said first sealing surface is releasable to permit external air to enter said air chamber through said air inlet aperture and said inlet hole, and wherein the engagement of said second gasket flange to said second sealing surface is releasable to permit pressurized air to enter said air-liquid mixing chamber through said air passage.

2. A liquid foaming dispenser as in claim 1 wherein said inlet hole is circumaxially formed about said deflection axis.

3. A liquid foaming dispenser, comprising:

a pump body having an air chamber and a liquid chamber, and a central axis that defines mutually perpendicular axial and radial directions;

a large piston rod having a hollow interior defining an air-liquid mixing chamber, an air inlet aperture for communicating air from an external environment to said air chamber, and an air passage for communicating air from said air chamber to said air-liquid mixing chamber;

a large piston positioned in said air chamber and sealingly engaged to said pump body, said large piston being axially movable by said large piston rod;

a liquid inlet including a first valve mechanism for regulating liquid flow into said liquid chamber;

a small piston rod including a second valve mechanism for regulating liquid flow from said liquid chamber to said air-liquid mixing chamber; and a large piston gasket having an inlet hole passing therethrough, said large piston gasket being secured to said large piston rod and including third and fourth valve mechanisms, said third valve mechanism regulating air flow through said inlet hole and having a first gasket flange biasing radially outwardly against said large piston rod to establish a releasable engagement forming said third valve mechanism, and said fourth valve mechanism regulating airflow through said air passage and having a second gasket flange biasing radially outwardly against said small piston rod to establish a releasable engagement forming said fourth valve mechanism.

4. A liquid foaming dispenser as in claim 3, including a deflection axis that is substantially parallel to said central axis, said deflection axis passing through said large piston gasket entirely within said inlet hole.

5. A liquid foaming dispenser as in claim 4 wherein said third valve mechanism is disposed radially outwardly of said deflection axis, and said fourth valve mechanism is disposed radially inwardly of said deflection axis.

6. A liquid foaming dispenser, comprising:

a pump body having an air chamber and a liquid chamber, and a central axis that defines mutually perpendicular axial and radial directions;

a large piston rod having a hollow interior defining an air-liquid mixing chamber, an air inlet aperture for communicating air from an external environment to said air chamber, an air passage for communicating air from said air chamber to said air-liquid mixing chamber, an inner securement channel with an outer stud, and an outer securement channel with an inner stud;

a large piston positioned in said air chamber and sealingly engaged to said pump body, said large piston being axially movable by said large piston rod;

a small piston rod, including a small piston base and a liquid passage;

a small piston positioned in said liquid chamber and sealingly engaged to said pump body, said small piston being axially movable by said small piston base, and being axially movable relative to said small piston base; and a large piston gasket having a main body portion, an inner circumaxial ring extending radially inwardly from said main body portion, an outer circumaxial ring extending radially outwardly from said main body portion, an inner securement flange extending axially in a first direction from said inner circumaxial ring to engage within said inner securement channel of said large piston rod, an outer securement flange securing axially in said first direction from said outer circumaxial ring to engage within said outer securement channel of said large piston rod, a first gasket flange extending from said main body portion and resiliently and radially outwardly biasing against a first sealing surface of said large piston rod, a second gasket flange extending from said main body portion and resiliently and radially outwardly biasing against a second sealing surface of said small piston rod, a deflection axis extending through said main body portion and substantially parallel to said central axis, and an inlet hole extending through said main body portion circumaxially of said deflection axis, wherein said first gasket flange forms a first valve mechanism for regulating airflow from an external environment through said inlet hole of said large piston gasket, and said second gasket flange forming a second valve mechanism for regulating airflow from said air chamber through said air passage.

7. A liquid foaming dispenser as in claim 6 wherein said air passage communicates air from said air chamber to said air-liquid mixing chamber.

8. A liquid foaming dispenser as in claim 6, including a pumping cap having a discharge nozzle and being arranged for pumping actuation of said large piston rod, said discharge nozzle being fluidly connected to said air-mixing chamber.

9. A liquid foaming dispenser as in claim 6, including a liquid inlet having a third valve mechanism for regulating liquid flow into said liquid chamber.

10. A liquid foaming dispenser as in claim 6 wherein said small piston forms a fourth valve mechanism for regulating liquid flow from said liquid chamber to said air-liquid mixing chamber.

11. A liquid foaming dispenser as in claim 6 wherein said first gasket flange is disposed radially outwardly from said deflection axis, and said second gasket flange is disposed radially inwardly from said deflection axis.

* * * * *